US006856100B1

(12) United States Patent
Konopka

(10) Patent No.: US 6,856,100 B1
(45) Date of Patent: Feb. 15, 2005

(54) BALLAST WITH INVERTER STARTUP CIRCUIT

(75) Inventor: John G. Konopka, Deer Park, IL (US)

(73) Assignee: Osrom Sylvania, Inc., Danvers, MA (US)

( * ) Notice: Subject to any disclaimer, the term of this patent is extended or adjusted under 35 U.S.C. 154(b) by 0 days.

(21) Appl. No.: 10/675,290

(22) Filed: Sep. 30, 2003

(51) Int. Cl.[7] ..... H05B 37/02
(52) U.S. Cl. ..... 315/224; 315/219; 315/DIG. 7
(58) Field of Search ..... 315/224, 219, 315/DIG. 5, DIG. 7

(56) References Cited

U.S. PATENT DOCUMENTS 5,315,214 A * 5/1994 Lesea ..... 315/209 R
5,925,990 A * 7/1999 Crouse et al. ..... 315/307

* cited by examiner

*Primary Examiner*—David Vu
(74) *Attorney, Agent, or Firm*—Kenneth D. Labudda

(57) ABSTRACT

A ballast (20, 20') includes a rectifier circuit (100), a boost converter (200, 200'), an inverter (300), an output circuit (400), and an inverter startup circuit (600). Inverter startup circuit (600) is coupled between boost converter (200) and inverter (300). During operation, inverter startup circuit (600) provides a delay period between startup of boost converter (200) and startup of inverter (300) so that startup of inverter (300) is delayed until at least such time as the DC rail voltage provided by boost converter (200) approaches its steady-state operating level. This ensures that the ballast (20,20') provides an output voltage that is sufficiently high to ignite a lamp (40) in a preferred manner, with little or no glow current and a fast strike time.

20 Claims, 4 Drawing Sheets

BALLAST WITH INVERTER STARTUP CIRCUIT

FIELD OF THE INVENTION

The present invention relates to the general subject of circuits for powering discharge lamps. More particularly, the present invention relates to a ballast with a novel inverter startup circuit.

BACKGROUND OF THE INVENTION

FIG. 1 describes a prior art ballast 10 for providing instant start operation of a gas discharge lamp 40. Ballast 10 includes a full-wave rectifier circuit 100, a boost converter 200, a self-oscillating current-fed half-bridge inverter 300, a parallel resonant output circuit 400, and an inverter startup circuit 500.

Before AC power is applied to ballast 10, boost converter 200 and inverter 300 are off. Once AC power is applied, boost converter 200 and inverter are still off, and the DC rail voltage $V_{DC}$ goes from zero to the peak of the voltage provided by AC voltage source 30. At that time, within inverter startup circuit 500, capacitor 540 begins to charge up (via connection point A and input 502) through resistor 510. Eventually, the voltage $V_X$ across capacitor 540 reaches the breakover voltage (e.g., 32 volts) of diac 550, at which point diac 550 turns on. When diac 550 turns on, the stored energy in capacitor 540 causes a current pulse to be injected (via output 504 and connection point B) into the base of lower inverter transistor 340, thereby causing inverter 300 to begin to operate. Diode 560 (which is connected to inverter output terminal 306 via output 506 and connection point C) prevents capacitor 540 from charging up and activating diac 550 while inverter 300 is operating.

Boost converter 200 begins to operate once boost control circuit 220 is activated, which (in general) may occur either before or after inverter 300 begins to operate. Once boost converter 200 begins to operate, $V_{DC}$ begins to increase (from the peak of the voltage provided by AC source 30) and eventually reaches its steady-state operating level.

For an instant start ballast, it is highly preferred that boost converter 200 begin to operate prior to startup of inverter 300. More particularly, it is preferred that inverter 300 be started only after $V_{DC}$ is high enough so that inverter 300 and output circuit 400 can provide a ballast output voltage that is sufficiently high to ignite lamp 40 in a preferred manner (i.e., with little or no glow current and a fast strike time).

In inverter startup circuit 500, the time that it takes for $V_X$ to reach the diac breakover voltage is a function of the magnitude of the voltage provided by AC source 30, the resistance of resistor 510, and the capacitance of capacitor 540. In theory, resistor 510 and capacitor 540 may be selected so that, for a given AC source voltage, inverter startup is delayed until $V_{DC}$ is at or near its steady-state operating level. Unfortunately, this is not true in practice because the permissible values for resistor 510 and capacitor 540 are heavily constrained by the electrical limitations of diac 550. In particular, the peak current and power ratings of diac 550 dictate that capacitor 540 must be fairly small (e.g., on the order of 0.1 microfarads or so), while the leakage current of diac 550 places an upper limit on resistor 510 (i.e., resistor 510 must be small enough to supply the maximum diac leakage current, as well as additional current for charging up capacitor 540). Thus, in practice, it is generally not possible to select resistor 510 and capacitor 540 so that inverter startup is delayed until $V_{DC}$ is at or near its steady-state operating level.

If the AC source voltage varies over a wide range (as it does in the case of so-called universal input voltage ballasts, wherein the nominal range of the AC source voltage is between 120 volts and 277 volts), the aforementioned difficulties are especially pronounced. For example, even if it were possible to design inverter startup circuit 500 so that lamp 40 receives optimal ignition voltage when the AC source voltage is 277 volts, the same will not occur when the AC source voltage is at 120 volts. Startup circuit 500 is therefore particularly ill-suited for universal input voltage applications.

What is needed, therefore, is a ballast with an inverter startup circuit that provides an appropriate delay period so that the ballast can provide sufficient voltage for igniting a lamp in a preferred manner. Such a ballast and inverter startup circuit would represent a significant advance over the prior art.

DETAILED DESCRIPTION OF THE PREFERRED EMBODIMENTS

Figure 1:
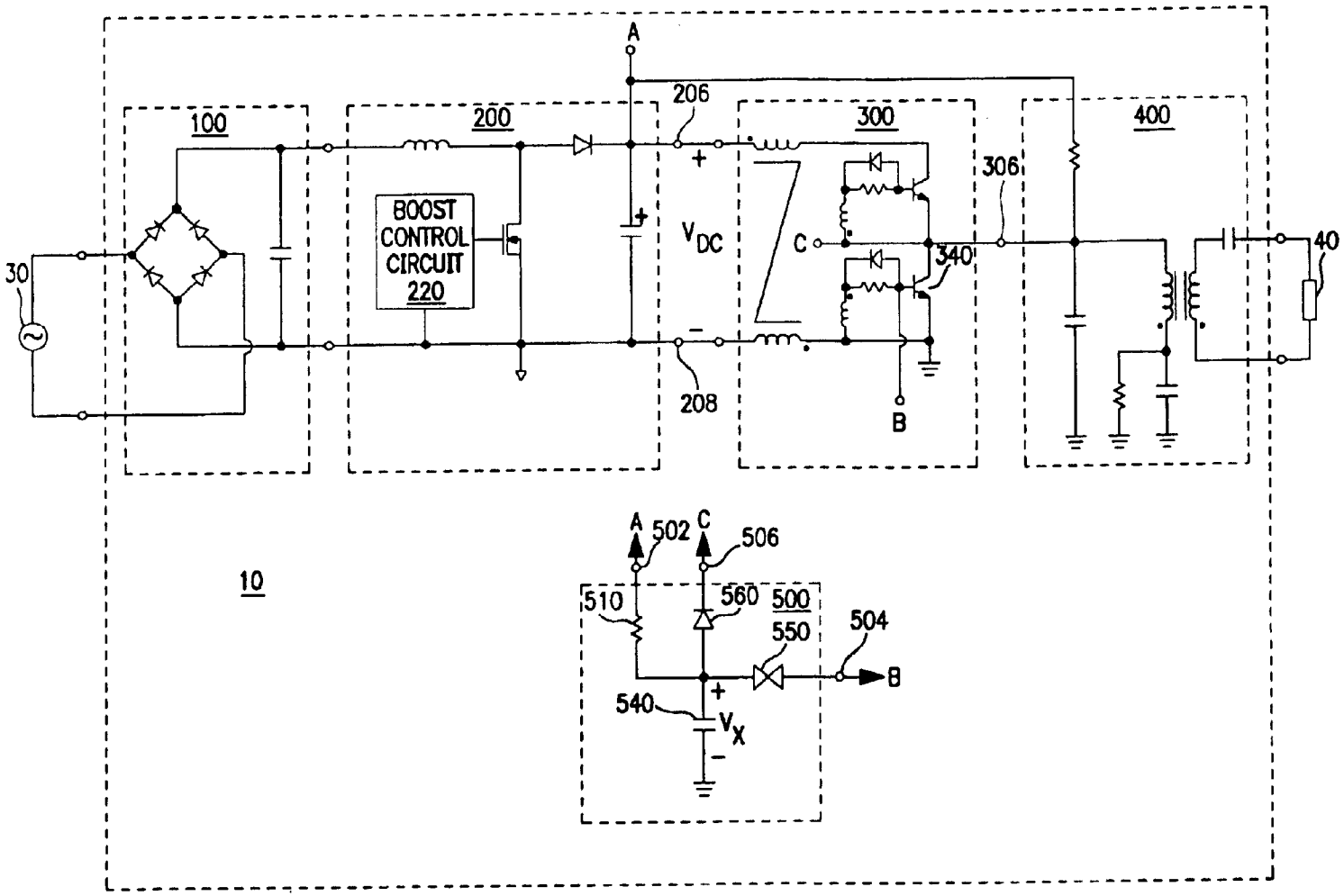
FIG. 1 PRIOR ART
FIG. 1 describes a prior art ballast and inverter startup circuit.
Figure 2:
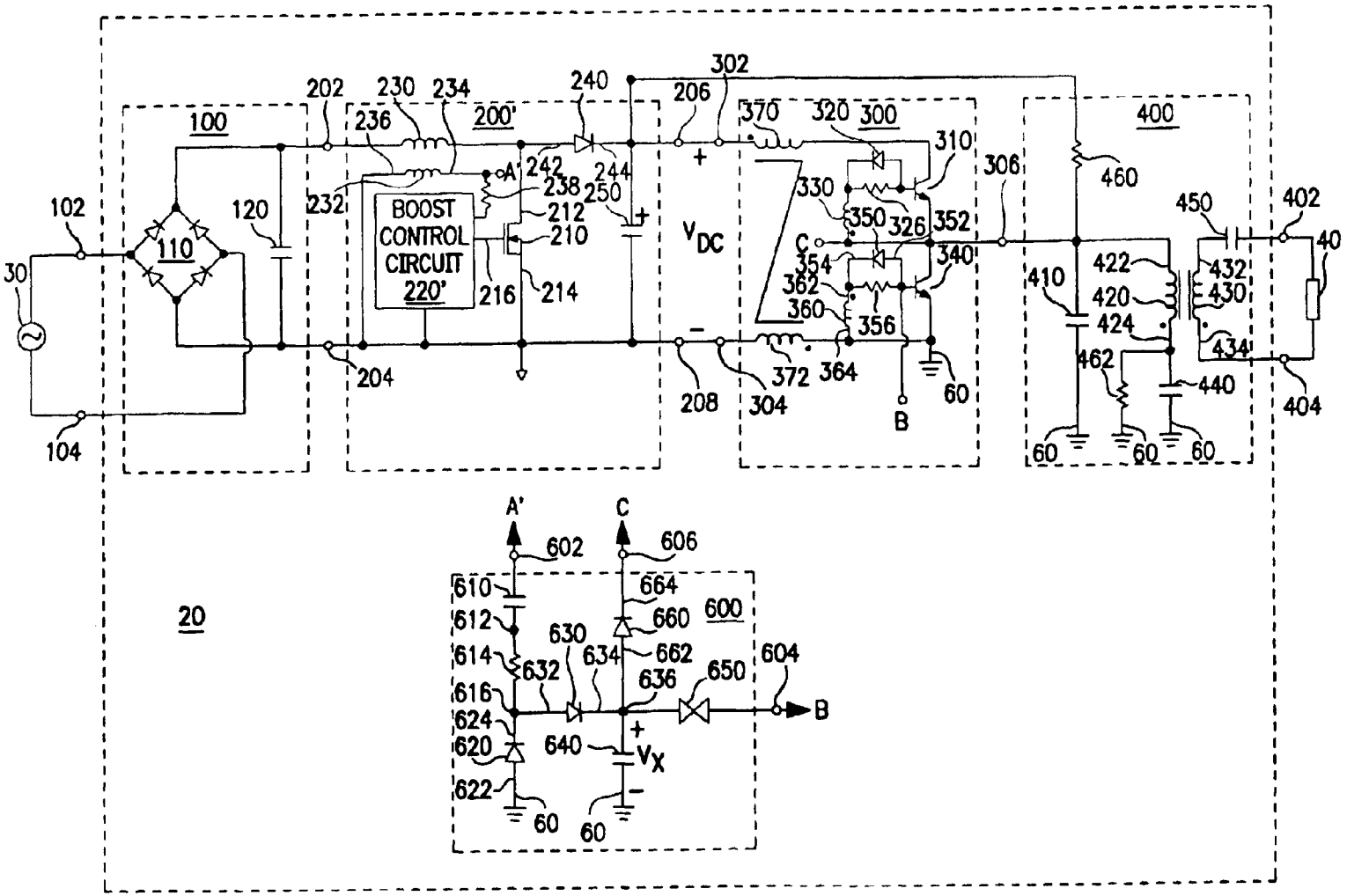
FIG. 2 is a schematic diagram of a ballast with an inverter startup circuit, in accordance with a first preferred embodiment of the present invention.

In a first preferred embodiment of the present invention, as described in FIG. 2, a ballast 20 includes a rectifier circuit 100, a boost converter 200', an inverter 300, an output circuit 400, and an inverter startup circuit 600.

Rectifier circuit 100 is adapted to receive a source 30 of alternating current (AC) line voltage, $V_{AC}$, having a certain magnitude (e.g., 120 volts RMS, 277 volts RMS, etc.) Boost converter 200' is coupled to rectifier circuit 100. During operation, boost converter 200' provides a substantially direct current (DC) rail voltage, $V_{DC}$, having a steady-state operating level. Inverter 300 is coupled to boost converter 200'. Output circuit 400 is coupled to inverter 300. During operation, output circuit 400 provides power to at least one gas discharge lamp 40. Inverter startup circuit 600 is coupled between boost converter 200' and inverter 300.

During operation, inverter startup circuit 600 provides a delay period between startup of boost converter 200' and startup of inverter 300 so that startup of inverter 300 is delayed until at least such time as the DC rail voltage, $V_{DC}$, approaches its steady-state operating level. Preferably, the delay period is set so that inverter 300 is started only after $V_{DC}$ reaches at least about 90% of its steady-state operating level. This ensures that inverter 300 is started only after $V_{DC}$ is high enough so that inverter 300 and output circuit 400 can provide a ballast output voltage that is sufficiently high to ignite lamp 40 in a proper manner (i.e., with little or no glow current and a fast strike time). Consequently, ballast 20 provides excellent lamp life and enhanced cold-strike (i.e., igniting a lamp at low temperatures) capability.

It is also preferred that the delay period changes in response to a change in the magnitude of the AC line voltage, so as to properly time the startup of inverter 300 under different AC line voltages; more particularly, it is preferred that the delay period will decrease in response to an increase in the magnitude of the AC line voltage. For example, in a prototype ballast configured substantially as described in FIG. 2 and with the corresponding component values specified herein, the delay period was 27 milliseconds for $V_{AC}$=120 volts RMS, and 12.5 milliseconds for $V_{AC}$=277 volts RMS. Thus, startup circuit 600 is especially suitable for universal input voltage ballasts that are intended to operate over a wide range (e.g., 120 volts to 277 volts) of AC source voltage.

A first preferred structure for ballast 20 is now described with reference to FIG. 2, as follows.

Rectifier circuit 100 comprises first and second input connections 102,104, a full-wave diode bridge 110, and a high frequency bypass capacitor 120. First and second input connections 102,104 are adapted to receive the source 30 of AC line voltage, $V_{AC}$. During operation, rectifier circuit 100 provides a substantially unfiltered, full-wave rectified version of $V_{AC}$ across capacitor 120.

Boost converter 200' comprises first and second input terminals 202,204, first and second output terminals 206, 208, a boost transistor 210, a boost control circuit 220', a boost inductor 230,232, a boost rectifier 240, and a bulk capacitor 250. Input terminals 202,204 are coupled to rectifier circuit 100. Second output terminal 208 is coupled to second input terminal 204. Boost transistor 210 has a first conduction terminal 212, a second conduction terminal 214, and control terminal 216. Second conduction terminal 214 is coupled to second input terminal 204 and second output terminal 208. Boost control circuit 220' is coupled to control terminal 216 of boost transistor 210. During operation, boost control circuit 220' commutates boost transistor 210 in a manner that is well known to those skilled in the art. Boost inductor 230,232 has a primary winding 230 and a secondary winding 232. Primary winding 230 is coupled between first input terminal 202 and first conduction terminal 212 of boost transistor 210. Secondary winding 232 has a first end 234 coupled to boost control circuit 220' via a resistor 238 and a second end 236 coupled to second input terminal 204. Boost rectifier 240 has an anode 242 coupled to first conduction terminal 212 of boost transistor 210 and a cathode 244 coupled to first output terminal 206. Finally, bulk capacitor 250 is coupled between first output terminal 206 and second output terminal 208.

During operation, boost converter 200' provides a substantially direct current (DC) rail voltage, $V_{DC}$, having a steady-state operating level (e.g., 450 volts). Boost transistor 210 may be implemented by a N-channel field-effect transistor (FET) wherein the drain of the FET is the same as first conduction terminal 212. Boost control circuit 220' may be implemented by any of a number of suitable circuits known to those skilled in the art. For example, boost control circuit 220' may be realized using a suitable power factor correction (PFC) integrated circuit, such as the MC33262 PFC integrated circuit manufactured by Motorola, Inc., along with associated peripheral components. Boost secondary winding 232 and resistor 238 serve as a zero current detection circuit that is required when boost control circuit 220' is realized using a PFC integrated circuit.

Inverter 300 comprises first and second input terminals 302,304, an inverter output terminal 306, upper and lower inverter transistors 310,340, a drive circuit 320,326,330 for upper transistor 310, a drive circuit 350,356,360 for lower transistor 340, and a current-feed inductor 370,372. Input terminals 302,304 are coupled to the output terminals 302, 304 of boost converter 200'. Inverter output terminal 306 is coupled to output circuit 400. Upper transistor 310 is coupled between first input terminal 302 and inverter output terminal 306. Lower transistor 340 is coupled between inverter output terminal 306 and circuit ground 60. The drive circuit for lower transistor 340 comprises a base-drive winding 360, a base-drive resistor 356, and a base-drive diode 350. Base-drive winding 360 has a first end 362 and a second end 364, the latter of which is coupled to circuit ground 60; as will be discussed in further detail below, base-drive winding 360 is magnetically coupled to a corresponding primary winding of an output transformer within output circuit 420. Base-drive resistor 356 is coupled between lower inverter transistor 340 and the first end 362 of base-drive winding 360. Base-drive diode 350 has an anode 352 coupled to lower inverter transistor 340 and a cathode 354 coupled to the first end 362 of base-drive winding 360. The drive circuit 320,326,330 for upper transistor 310 has an analogous structure. Current-feed inductor 370,372 includes an upper winding 370 and a lower winding 372. Upper winding 370 is coupled between first input terminal 302 and upper transistor 310. Lower winding 372 is coupled between second input terminal 304 and circuit ground 60. Upper winding 370 and lower winding 372 are magnetically coupled to each other. The detailed operation of inverter 300 is well known to those skilled in the art.

Output circuit 400 comprises first and second output connections 402,404, a resonant capacitor 410, an output transformer 420,430, a direct current (DC) blocking capacitor 440, a ballasting capacitor 450, and resistors 460,462. Output connections 402,404 are adapted for connection to a lamp load comprising at least one gas discharge lamp 40. Resonant capacitor 410 is coupled between first output connection 402 and circuit ground 60. Output transformer 420,430 has a primary winding 420 and a second winding 430. Primary winding 420 has a first end 422 and a second end 424, wherein first end 422 is coupled to inverter output terminal 306. Secondary winding 430 has a first end 432 and a second end 434, wherein second end 434 is coupled to second output connection 404. Ballasting capacitor 450 is coupled between the first end 432 of secondary winding 430 and first output connection 402. Resistor 460 is coupled between the first output terminal 206 of boost converter 200' and inverter output terminal 306. DC blocking capacitor 440 and resistor 462 are each coupled between the second end 424 of primary winding 420 and circuit ground 60.

Inverter startup circuit 600 includes an input terminal 602, a first output terminal 604, a second output terminal 602, a first capacitor 610, a resistor 614, a first diode 620, a second diode 630, a second capacitor 640, a voltage breakdown device 650, and a third diode 660. Input terminal 602 is coupled to boost converter 200'. First and second output terminals 604,606 are coupled to inverter 300. First capacitor 610 is coupled between input terminal 602 and a first node 612. Resistor 614 is coupled between first node 612 and a second node 616. First diode 620 has an anode 622 coupled to circuit ground 60 and a cathode 624 coupled to second node 616. Second diode 630 has an anode 632 coupled to second node 616 and a cathode 634 coupled to a third node 636. Second capacitor 640 is coupled between third node 636 and circuit ground 60. Voltage breakdown device 650, which is preferably implemented as a diac, is coupled between third node 636 and first output terminal 604. Finally, third diode 660 has an anode 662 coupled to third node 636 and a cathode coupled to second output terminal 606.

During operation, diac 650 conducts current when a predetermined breakdown voltage is provided between third node 636 and circuit ground 60; stated another way, diac 650 turns on when the voltage $V_X$ across capacitor 640 reaches the diac breakdown voltage (e.g., 32 volts). Diac 650 is non-conductive (i.e., remains off) prior to $V_X$ reaching the breakdown voltage. Diode 660 prevents activation of diac 650 after inverter 300 begins to operate. Diode 660 accomplishes this by effectively connecting capacitor 540 to circuit ground 60 each time that lower inverter transistor 340 turns on, thus preventing $V_X$ from building up (and eventually reaching the diac breakover voltage and activating the diac) so long as inverter 300 is operating.

As described in FIG. 2, the input terminal 602 inverter startup circuit 600 is coupled (via connection point A') to the first end 234 of the secondary winding 232 of boost inductor 230,232. First output terminal 604 is coupled (via connection point B) to lower inverter transistor 340 and the anode 352 of base-drive diode 350. Second output terminal 606 is coupled (via connection point C) to inverter output terminal 306.

Preferred component values for implementing startup circuit 600 in ballast 20 are given as follows:

Capacitor 610: 220 picofarad
Resistor 614: 10 kilohms
Diodes 620,630: 1N4148
Diode 660: RGP10J
Capacitor 640: 0.1 microfarad
Diac: SB3

Figure 3:
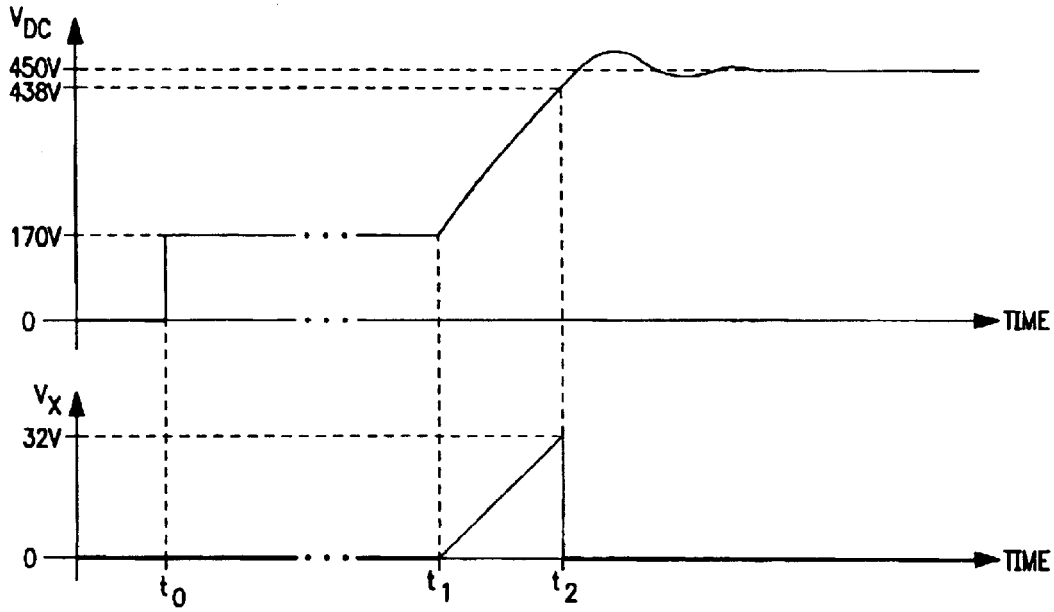
FIG. 3 describes the DC rail voltage and diac starting voltage in the ballast described in FIG. 2 when the AC source voltage is 120 volts (RMS), in accordance with the first preferred embodiment of the present invention.

The detailed operation of inverter startup circuit 600 is now explained with reference to FIGS. 2 and 3 as follows.

When AC power is first applied to ballast 20 at $t=t_0$, boost converter 200 and inverter 300 are initially off. As shown in FIG. 3, when AC power is applied at t=to, $V_{DC}$ goes from zero to a value that is approximately equal to the peak of $V_{AC}$, and remains at that value until boost converter 200 begins to operate at $t=t_1$. Prior to $t=t_1$, the voltage at point A' is zero, so startup circuit 600 is inoperable.

At $t=t_1$, boost control circuit 220 turns on and begins to commutate boost transistor 210. Each time that boost transistor 210 is turned on and then off (i.e., one switching cycle), energy is transferred into capacitor 250, causing $V_{DC}$ to increase. At the same time, a positive voltage appears at point A' during the portion of each switching cycle when boost transistor 210 is turned on. The positive voltage at point A' causes a positive current to flow into input terminal 602 of startup circuit 600. This positive current flows through capacitor 610 and diode 630 and into capacitor 640, thus charging capacitor 640 and causing $V_X$ to increase by a small amount.

When the voltage at point A' is negative, no charging current in provided to capacitor 640; rather, current flows up from circuit ground 60 through diode 620, resistor 614, capacitor 610, and out of input terminal 602. During those times, diode 630 is reverse-biased and $V_X$ is maintained until such time as the voltage at point A' goes positive once again and charging current is once again delivered to capacitor 640, causing $V_X$ to increase further.

Thus, during each switching cycle of boost transistor 210, capacitor 640 is charged up by a small amount; that is, $V_X$ increases in a small stepwise increments. Eventually, at $t=t_2$, after many such switching cycles have occurred, $V_X$ reaches the breakover voltage (e.g., 32 volts) of diac 650. At that time, diac 650 turns on and the stored energy in capacitor 640 causes a current pulse to be injected (via first output terminal 604 and connection point B) into the base of lower inverter transistor 340, thereby causing inverter 300 to begin operating. By that time ($t=t_2$), $V_{DC}$ has increased to a level (e.g., 438 volts) that approaches its steady-state operating level (e.g., 450 volts), so the voltage that is provided between output connections 402,404 is sufficiently high to ignite lamp 40 in a preferred manner. In this way, startup circuit 600 delays inverter startup so as to provide an optimal or near optimal voltage for igniting lamp 40.

Figure 4:
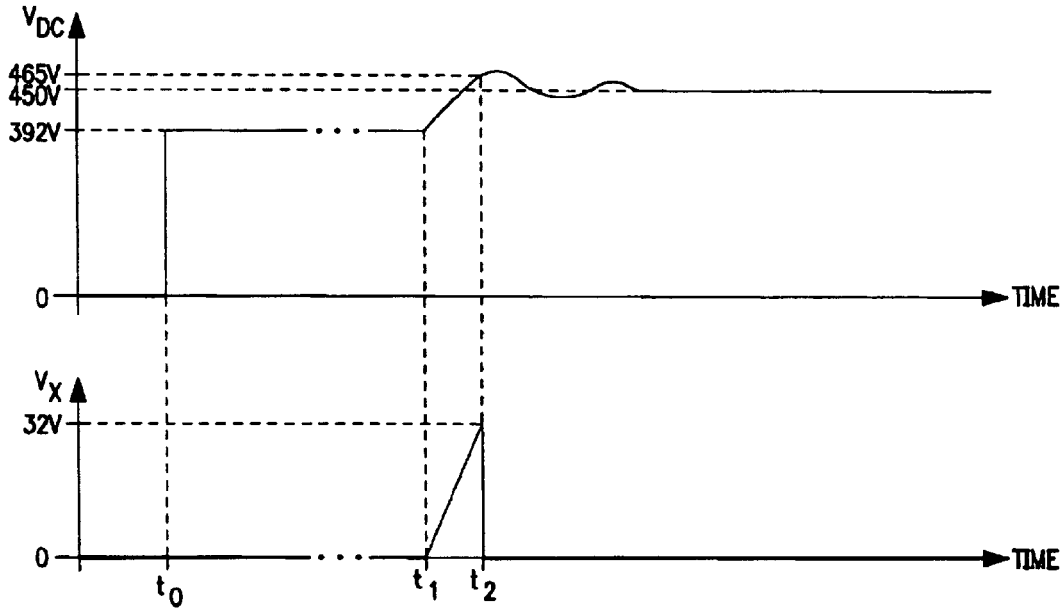
FIG. 4 describes the DC rail voltage and diac starting voltage in the ballast described in FIG. 2 when the AC source voltage is 277 volts (RMS), in accordance with the first preferred embodiment of the present invention.

With the component values recited above, startup circuit 600 provides a delay period (i.e., $t_2-t_1$) of about 27 milliseconds when $V_{AC}$ is at 120 volts RMS. Referring to FIG. 4, when $V_{AC}$ is at 277 volts (RMS), startup circuit 600 provides a delay period of about 12.5 milliseconds.

Figure 5:
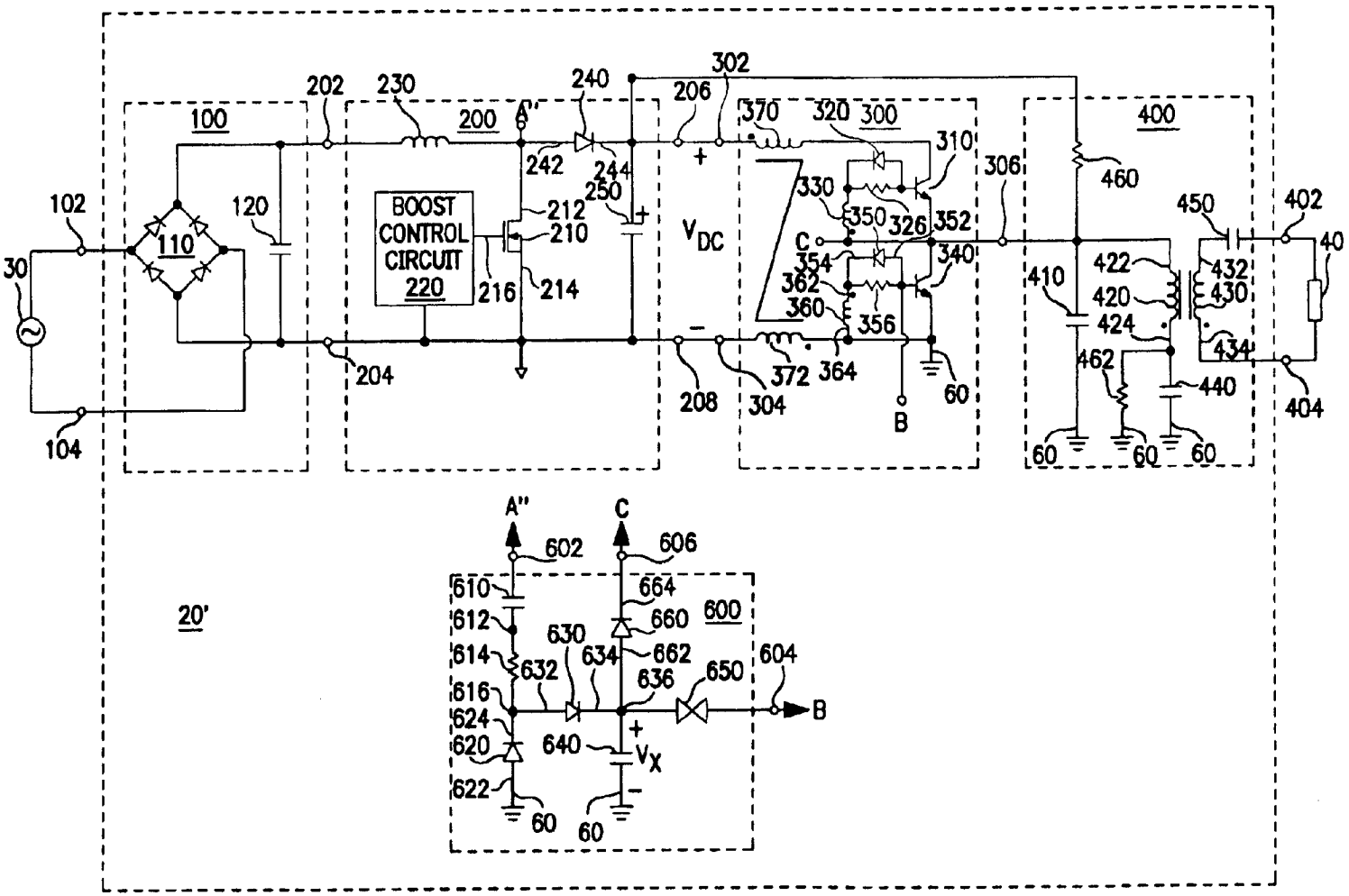
FIG. 5 is a schematic diagram of a ballast with an inverter startup circuit, in accordance with a second preferred embodiment of the present invention.

A second preferred embodiment of the present invention is described in FIG. 5. Ballast 20' is substantially similar to ballast 20, which has been described above, but with the following differences:

(1) In ballast 20', boost converter 20 need not have a zero current detection circuit (i.e., a secondary winding on the boost inductor) and boost control circuit 220' may be implemented with circuitry other than a PFC integrated circuit.

(2) In ballast 20', input terminal 600 of inverter startup circuit 600 is coupled (via connection point A") to the first conduction terminal 212 of boost transistor 210.

(3) In ballast 20', the preferred structure of inverter startup circuit 600 is the same as previously described with regard to ballast 20, except that the preferred values for several of the components are now as follows:

Capacitor 610: 100 picofarad
Resistor 614: 266 kilohms (two 133 kilohm resistors in series)
Diodes 620,630: 1N4148
Diode 660: RGP10J
Capacitor 640: 0.1 microfarad
Diac: SB3

Note that resistor 614 is now implemented as two series-connected resistors because of peak voltage considerations; that is, because the voltage at connection point A" is quite high (on the order of several hundred volts), multiple resistors are needed in order to avoid component degradation/failure due to high voltage.

The detailed operation of ballast 20' and startup circuit 600 is substantially similar to that which was previously described with reference to ballast 20 and FIG. 2. In ballast 20', with the component values described above, startup circuit 600 provides delay periods of about 15 milliseconds for $V_{AC}$=120 volts RMS, and about 7 milliseconds for $V_{AC}$=277 volts.

The following design considerations should be observed in practicing the present invention:

(1) The delay period is a function of the magnitude of the voltage at connection point A' or connection point A" (which depends on $V_{AC}$), the capacitance of capacitor 610, and the resistance of resistor 614. For a given set of values for capacitor 610 and resistor 614, the delay period will be highest under low-line conditions (i.e., $V_{AC}$=108 volts RMS or so) and lowest under high-line conditions (i.e., $V_{AC}$=304 volts RMS or so). Capacitor 610 and resistor 614 are chosen so as to provide a suitable compromise between the delay periods that occur at these extremes in the range of $V_{AC}$.

(2) It is desirable that that the delay period be set large enough so that inverter startup is delayed until $V_{DC}$ approaches (e.g., reaches at least about 90% of) its steady-state value. This is to ensure that sufficient voltage is developed for igniting the lamp in a preferred manner.

(3) On the other hand, it is essential that the delay period be set small enough to allow $V_X$ to reach the diac breakover voltage before $V_{DC}$ reaches (and subsequently begins to overshoot) its steady-state value, at which point the switching duty cycle provided by the boost control circuit becomes very low as boost control circuit attempts to keep $V_{DC}$ at its steady-state value. Once the switching duty cycle becomes very low, the voltage at point A' or A" may become too small to continue charging up capacitor 640, in which case $V_X$ will never reach the diac breakover voltage and startup circuit 600 will be unable to fulfill its intended purpose of starting inverter 300.

(4) For ballasts in which the boost control circuit relies on the inverter for steady-state operating power, the startup circuit for the boost control circuit must be designed to provide a holdup time (i.e., to keep the boost control circuit operating until the inverter starts) that is longer than the largest possible delay period of inverter startup circuit 600. Otherwise, the boost control circuit will cease operating before the inverter starts, in which case the inverter will never start because $V_X$ will have been prevented from reaching the diac breakover voltage. Sufficient holdup time for the boost control circuit is provided by ensuring that the capacitance of the boost startup capacitor is suitably large. For example, in ballast 20 (FIG. 2) with the component values described herein, the boost startup capacitor should be at least 68 microfarads; in ballast 20' (FIG. 5) with the component values described herein, the boost startup capacitor should be at least 47 microfarads.

Although the present invention has been described with reference to certain preferred embodiments, numerous modifications and variations can be made by those skilled in the art without departing from the novel spirit and scope of this invention. For instance, it should be appreciated that the principles and advantages of the present invention are not necessarily limited to ballasts that include a self-oscillating current-fed inverter. With minor modifications (e.g., removal of diac 650 and diode 660, and suitable adjustment of the values of capacitor 610, resistor 614, and capacitor 640), inverter startup circuit 600 may be used to control startup of a driven inverter (e.g., with a driver integrated circuit).

What is claimed is:

1. An electronic ballast, comprising:

a rectifier circuit adapted to receive a source of alternating current (AC) line voltage, the AC line voltage having a magnitude;

a boost converter coupled to the rectifier circuit and operable to provide a substantially direct current (DC) rail voltage having a steady-state operating level;

an inverter coupled to the boost converter;

an output circuit coupled to the inverter and operable to provide power to at least one gas discharge lamp;

an inverter startup circuit coupled between the boost converter and the inverter, wherein the inverter startup circuit is operable to provide a delay period between startup of the boost converter and startup of the inverter such that startup of the inverter is delayed until at least such time as the DC rail voltage approaches its steady-state operating level.

2. The ballast of claim 1, wherein the inverter startup circuit is operable to start the inverter only after the DC rail voltage reaches at least ninety percent of its steady-state operating level.

3. The ballast of claim 1, wherein the delay period changes in response to a change in the magnitude of the AC line voltage.

4. The ballast of claim 1, wherein the delay period decreases in response to an increase in the magnitude of the AC line voltage.

5. The ballast of claim 3, wherein:

when the root-mean-square (RMS) magnitude of the AC line voltage is about 120 volts, the delay period is about 27 milliseconds; and when the RMS magnitude of the AC line voltage is about 277 volts, the delay period is about 12.5 milliseconds.

6. The ballast of claim 1, wherein the root-mean-square (RMS) magnitude of the AC line voltage is variable between about 120 volts and about 277 volts.

7. The ballast of claim 1, wherein the inverter startup circuit comprises:

an input terminal coupled to the boost converter;

first and second output terminals coupled to the inverter;

a first capacitor coupled between the input terminal and a first node;

a resistor coupled between the first node and a second node;

a first diode having an anode coupled to circuit ground and a cathode coupled to the second node;

a second diode having an anode coupled to the second node and a cathode coupled to a third node;

a second capacitor coupled between the third node and circuit ground;

a voltage breakdown device coupled between the third node and the first output terminal, the voltage breakdown device being operable to conduct current in response to a predetermined breakdown voltage being provided between the third node and circuit ground; and a third diode having an anode coupled to the third node and a cathode coupled to the second output terminal.

8. The ballast of claim 7, wherein the voltage breakdown device is a diac.

9. An electronic ballast, comprising:

a rectifier circuit adapted to receive a source of alternating current (AC) line voltage;

a boost converter operable to provide a substantially direct current (DC) rail voltage having a steady-state operating level, the boost converter comprising:

first and second input terminals coupled to the rectifier circuit;

first and second output terminals, the second output terminal being coupled to second input terminal;

a boost transistor having a first conduction terminal, a second conduction terminal, and a control terminal, wherein the second conduction terminal is coupled to the second input terminal;

a boost control circuit coupled to the control terminal of the boost transistor and operable to commutate the boost transistor;

a boost inductor having a primary winding coupled between the first input terminal and the first conduction terminal of the boost transistor;

a boost rectifier having an anode and a cathode, wherein the anode is coupled to the first conduction terminal of the boost transistor and the cathode is coupled to the first output terminal; and a bulk capacitor coupled between the first and second output terminals;

an inverter, comprising:

first and second input terminals coupled to the first and second output terminals of the boost converter;

an inverter output terminal coupled to the output circuit;

an upper inverter transistor coupled between the first input terminal and the output terminal;

a lower inverter transistor coupled between the output terminal and circuit ground;

a drive circuit for the upper transistor; and a drive circuit for the lower transistor;

an output circuit coupled to the inverter and operable to provide power to at least one gas discharge lamp;

an inverter startup circuit operable to delay starting the inverter until at least such time as the boost converter begins to operate and the DC rail voltage approaches its steady-state operating level, the inverter startup circuit comprising:

an input terminal coupled to the boost converter;

a first output terminal coupled to the drive circuit for the lower transistor; and a second output terminal coupled to the inverter output terminal.

10. The ballast of claim 9, wherein the input terminal of the inverter startup circuit is coupled to the first conduction terminal of the boost transistor.

11. The ballast of claim 9, wherein:

the boost inductor further comprises a secondary winding having a first end coupled to the boost control circuit and a second end coupled to the second input terminal of the boost converter; and the input terminal of the inverter startup circuit is coupled to the first end of the secondary winding of the boost inductor.

12. The ballast of claim 9, wherein:

the output circuit comprises:

first and second output connections adapted for connection to at least one gas discharge lamp;

a resonant capacitor coupled between the inverter output terminal and circuit ground;

an output transformer comprising a primary winding and a secondary winding, wherein:

the primary winding has a first end and a second end, the first end being coupled to the inverter output terminal;

the secondary winding has a first end and a second end, the second end being coupled to the second output connection;

a direct current (DC) blocking capacitor coupled between circuit ground and the second end of the primary winding of the output transformer;

a ballasting capacitor coupled between the first end of the secondary winding and the first output connection;

the drive circuit for the lower inverter transistor comprises:

a base-drive winding that is magnetically coupled to the primary winding of the output transformer, the base-drive winding having a first end and a second end, the second end being coupled to circuit ground;

a base-drive resistor coupled between the first end of the base-drive winding and the lower inverter transistor; and a base-drive diode having an anode and a cathode, wherein the anode is coupled to the lower inverter transistor and the cathode is coupled to the first end of the base-drive winding; and wherein the first output terminal of the inverter startup circuit is coupled to the anode of the base-drive diode.

13. The ballast of claim 9, wherein the inverter startup circuit further comprises:

a first capacitor coupled between the input terminal and a first node;

a resistor coupled between the first node and a second node;

a first diode having an anode coupled to circuit ground and a cathode coupled to the second node;

a second diode having an anode coupled to the second node and a cathode coupled to a third node;

a second capacitor coupled between the third node and circuit ground;

a voltage breakdown device coupled between the third node and the first output terminal, the voltage breakdown device being operable to conduct current in response to a predetermined breakdown voltage being provided at the third node; and a third diode having an anode coupled to the third node and a cathode coupled to the second output terminal.

14. The ballast of claim 13, wherein the voltage breakdown device is a diac.

15. The ballast of claim 13, wherein the input terminal of the inverter startup circuit is coupled to the first conduction terminal of the boost transistor.

16. The ballast of claim 13 wherein:

the boost inductor further comprises a secondary winding having a first end coupled to the boost control circuit and a second end coupled to the second input terminal of the boost converter; and the input terminal of the inverter startup circuit is coupled to the first end of the secondary winding of the boost inductor.

17. The ballast of claim 13, wherein:

the output circuit comprises:

first and second output connections adapted for connection to at least one gas discharge lamp;

a resonant capacitor coupled between the inverter output terminal and circuit ground;

an output transformer comprising a primary winding and a secondary winding, wherein:

the primary winding has a first end and a second end, the first end being coupled to the inverter output terminal;

the secondary winding has a first end and a second end, the second end being coupled to the second output connection;

a direct current (DC) blocking capacitor coupled between circuit ground and the second end of the primary winding of the output transformer;

a ballasting capacitor coupled between the first end of the secondary winding and the first output connection;

the drive circuit for the lower inverter transistor comprises:

a base-drive winding that is magnetically coupled to the primary winding of the output transformer, the base-drive winding having a first end and a second end, the second end being coupled to circuit ground;

a base-drive resistor coupled between the first end of the base-drive winding and the lower inverter transistor; and a base-drive diode having an anode and a cathode, wherein the anode is coupled to the lower inverter transistor and the cathode is coupled to the first end of the base-drive winding; and wherein the first output terminal of the inverter startup circuit is coupled to the anode of the base-drive diode.

18. An electronic ballast, comprising:

a rectifier circuit adapted to receive a source of alternating current (AC) line voltage;

a boost converter, comprising:

first and second input terminals coupled to the rectifier circuit;

first and second output terminals, the second output terminal being coupled to the second input terminal;

a boost transistor having a first conduction terminal, a second conduction terminal, and a control terminal, wherein the second conduction terminal is coupled to the second input terminal;

a boost control circuit coupled to the control terminal of the boost transistor and operable to commutate the boost transistor;

a boost inductor having a primary winding coupled between the first input terminal and the first conduction terminal of the boost transistor;

a boost rectifier having an anode and a cathode, wherein the anode is coupled to the first conduction terminal of the boost transistor and the cathode is coupled to the first output terminal; and a bulk capacitor coupled between the first and second output terminals;

an inverter, comprising:

first and second input terminals coupled to the first and second output terminals of the boost converter;

an inverter output terminal coupled to the output circuit;

an upper inverter transistor coupled between the first input terminal and the output terminal;

a lower inverter transistor coupled between the output terminal and circuit ground;

a drive circuit for commutating the upper and lower inverter transistors in a substantially complementary manner;

an output circuit coupled to the inverter and operable to provide power to at least one gas discharge lamp; and an inverter startup circuit, comprising:

an input terminal coupled to the boost converter;

a first output terminal coupled to the drive circuit of the inverter;

a second output terminal coupled to the inverter output terminal;

a first capacitor coupled between the input terminal and a first node;

a resistor coupled between the first node and a second node;

a first diode having an anode coupled to circuit ground and a cathode coupled to the second node;

a second diode having an anode coupled to the second node and a cathode coupled to a third node;

a second capacitor coupled between the third node and circuit ground;

a diac coupled between the third node and the first output terminal; and a third diode having an anode coupled to the third node and a cathode coupled to the second output terminal.

19. The ballast of claim 18, wherein the input terminal of the inverter startup circuit is coupled to the first conduction terminal of the boost transistor.

20. The ballast of claim 18, wherein:

the boost inductor further comprises a secondary winding having a first end coupled to the boost control circuit and a second end coupled to the second input terminal of the boost converter; and the input terminal of the inverter startup circuit is coupled to the first end of the secondary winding of the boost inductor.

* * * * *